US005491313A

United States Patent [19]

Bartley et al.

[11] Patent Number: 5,491,313

[45] Date of Patent: Feb. 13, 1996

[54] HALO LIGHTING FOR KEYPAD SWITCH ASSEMBLIES

[75] Inventors: Robert M. Bartley, Ravenna; Michael E. Conway, Youngstown; Harry J. Millard, III, Berlin Center, all of Ohio

[73] Assignee: General Motors Corporation, Detroit, Mich.

[21] Appl. No.: 279,147

[22] Filed: Jul. 22, 1994

[51] Int. Cl.[6] ..... H01H 9/00

[52] U.S. Cl. ..... 200/310; 200/314; 200/313; 200/512

[58] Field of Search ..... 200/310, 314, 200/311, 313, 317, 512, 292, 312, 315, 520, 510, 511

[56] References Cited

U.S. PATENT DOCUMENTS

| | | | |
|---|---|---|---|
| 4,343,975 | 9/1981 | Sado | 200/314 |
| 4,772,769 | 9/1988 | Shumede | 200/314 |
| 5,128,842 | 7/1992 | Kenmochi | 200/314 |

FOREIGN PATENT DOCUMENTS 59-181522 12/1984 Japan .

*Primary Examiner*—Henry J. Recla
*Assistant Examiner*—David J. Walczak
*Attorney, Agent, or Firm*—William A. Schuetz

[57] ABSTRACT

An illuminated elastomeric keypad switch assembly has a keypad and key caps which are illuminated by light passing through thin webs connecting the key caps to the keypad to create a halo lighting effect surrounding the key caps.

9 Claims, 2 Drawing Sheets

HALO LIGHTING FOR KEYPAD SWITCH ASSEMBLIES

The present invention relates to an elastomeric keypad switch assembly and, more particularly, to an illuminated, elastomeric keypad switch assembly having key caps which are illuminated by light passing through thin webs connecting the key caps to the keypad to create a halo lighting effect surrounding the key caps.

It is common in automotive applications to illuminate switch assemblies so that they can be easily located and identified in a darkened environment, such as nighttime driving. These switches are usually located on a vehicle dashboard or on interior trim door panel.

It is also common to employ elastomeric keypad switch assemblies having depressible key caps for moving an electrically conductive pellet mounted on its underside into and out of engagement with contacts on a printed circuit board. A common method of illuminating such a switch assembly is to mold the keypad out of a clear or translucent material and then paint the visible surface. A laser is then employed to etched a symbol or word on the key which exposes the clear material. Light can then be transmitted through the exposed etch symbol or word in the key caps of the keyboard by an optical conductor located beneath the keypad. Another obvious way to illuminate the switch assembly is to provide for an overhead lighting system and shine a light onto the surface of the switch assembly.

The present invention provides a new and improved elastomeric keypad switch assembly, especially for automotive use, having an inexpensive, novel illumination feature. The illumination feature provides a halo light effect surrounding the key caps in the keypad switch assembly.

In accordance with the provisions of the presnet invention, the novel elastomeric illuminated keypad switch assembly comprises an optical conductor, preferably a thin planar optical conductor, which is adapted to be connected to a light source, a printed circuit means including a transparent base secured to the optical conductor and which is adapted to be electrically connected to various electrical devices to be energized and de-energized and a one piece keypad made from an elastomeric material and overlying the printed circuit means. The keypad has a base of a thickness such that light from the optical conductor does not pass therethrough. The keypad also has a plurality of opaque key caps each having a bottom surface carrying an electrically conductive pellet and located above a pair of contact ends on printed circuit lines of the printed circuit board. The keypad further includes thin annular translucent webs for integrally connecting the key caps to the keypad and with the key caps each having an outer peripheral side wall which is spaced inwardly from a side wall of the keypad surrounding the key caps and with the thin annular webs being integral with the side wall of the keypad adjacent its underside and integral with the key caps adjacent its bottom side. The annular side walls of the keypad and side walls of the key caps and the thin annular webs define annular recesses or wells in the keypad surrounding the key caps. The thin annular webs function to bias the caps toward a normal position and which its pellets carried thereby are spaced from the contact ends of the printed circuit lines and the key caps are depressible to deflect the annular webs to move the pellets carried thereby to engage the contact ends of the printed circuit lines to complete a circuit. The annular webs function as both a spring to bias the key caps toward their normal position and to transmit light therethrough and with the side walls of the keypad serving to direct light through the web to create a visible halo lighting effect surrounding the key caps.

The advantage of the novel keypad switch assembly of the present invention is that the keypad can be designed so that its base and key caps are provided with a thickness such that light passage therethrough is prevented and so that all of the light must pass through the annular translucent webs. Moreover, the design of the keypad with the thin annular translucent webs of the key caps and its location in a well between the side walls of the raised key caps and the keypad controls the light output and creates a unique halo lighting effect surrounding the key caps. In addition, the elastomeric keypad can be molded in any suitable color, except extremely dark colors such as black, and when the switch assembly is assembled and operated it provides a halo illumination feature whose color complements the color of the keypad switch assembly so that the halo light and the switch assembly are color coordinated. This provides for an appealing aesthetic appearance.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
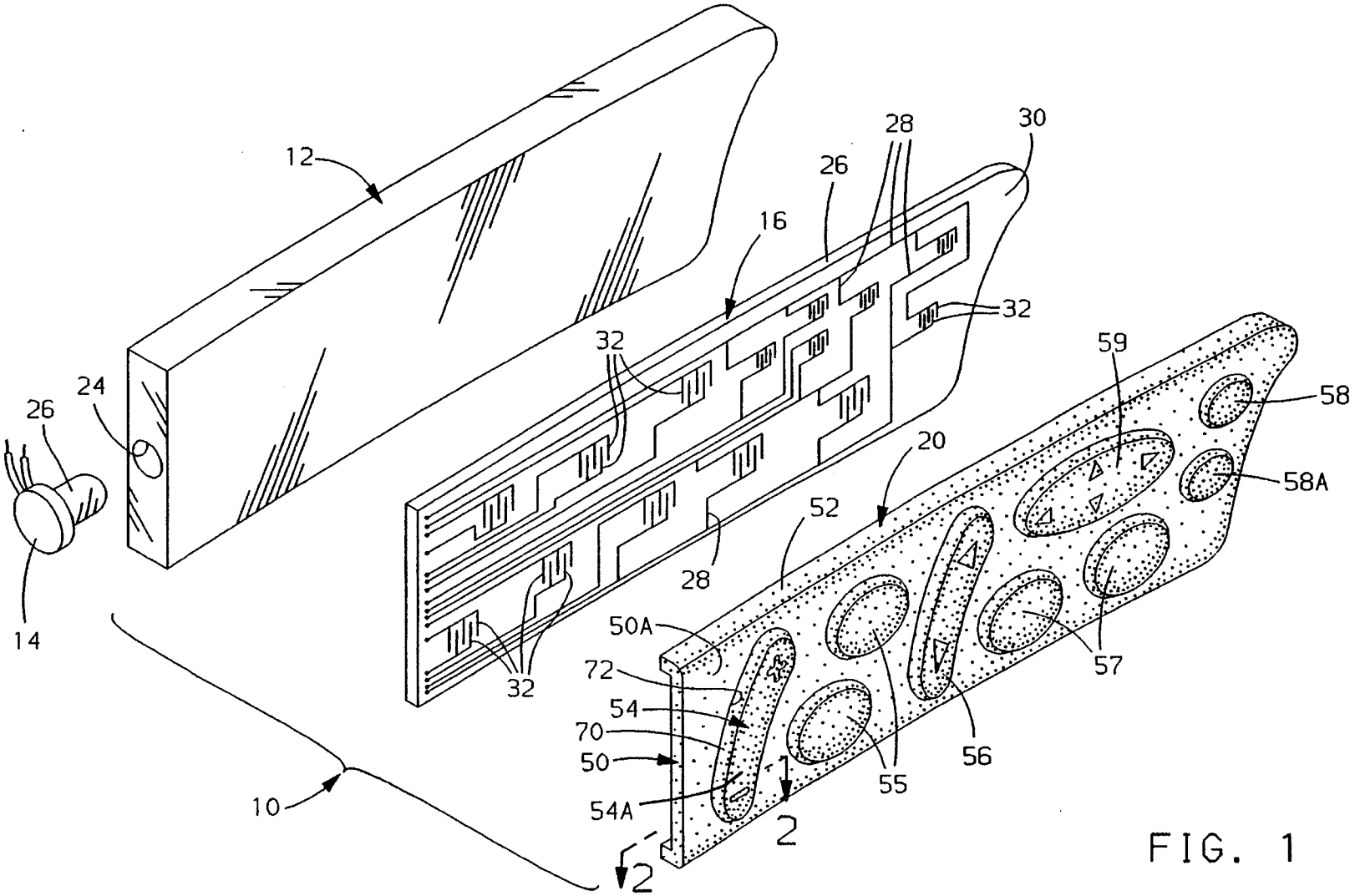
FIG. 1 is an exploded perspective view of an elastomeric keypad switch assembly embodying the present invention.

The present invention provides a novel elastomeric keypad switch assembly 10. The switch assembly 10 comprises, in general, an optical light transmitting conductor or light pipe 12 which is adapted to be operatively connected with a suitable light source 14, a printed circuit means 16 which is secured to the optical conductor 12 and which is adapted to be electrically connected to various electrical devices to be energized and de-energized and a one piece keypad 20 made from an elastomeric material and overlying the printed circuit means 16.

The optical conductor or light pipe 12 comprises a one piece planar member made from a suitable light conducting material such as a suitable plastic. The planar member has a bulb or fiber optic receiving opening 24 at its left end, as viewed in FIG. 1, for receiving a bulb or fiber optic 26 of the light source 14.

The printed circuit means 16 comprises a base 26 made from a clear or transparent material and a plurality of printed circuit lines or traces 28 on its side 30 facing the keypad 20. Various or selected ones of the printed circuit lines 28 terminate in contact ends 32 which are located closely adjacent each other, as best shown in FIG. 1. The printed circuit base 26 could either be made from a rigid transparent material or could be made from a suitable flexible transparent membrane material, such as mylar and the various circuit lines 28 would be connectable to input and output conductors of a suitable wiring harness (not shown) which is connected thereto in any suitable or conventional manner, such as by soldering or by pins. The printed circuit base 26 is shaped complementary with the optical conductor or light pipe 12 and is adapted to be secured thereto by any suitable means, such as by fasteners or suitable adhesive means.

The keypad 20 is of a one piece, molded elastomeric construction and it comprises a planar base 50 having an integral flange 52 extending perpendicular thereto around three sides thereof, as viewed in FIG. 1. The keypad 20 can be secured to the printed circuit means by any suitable means, but is preferably adhesively secured to the printed circuit means 16 and/or light pipe 12 and is shaped complementary to the printed circuit means and light pipe 12. That is, the flange 52 extends along its upper side, its right side and its lower side, as viewed in FIG. 1. The flange 52 at its left side has an opening or cut out to permit the light pipe to be connected to the light source 14. The base 50 is planar and is molded of a thickness such that no light can be transmitted therethrough from the light pipe 12.

Figure 2:
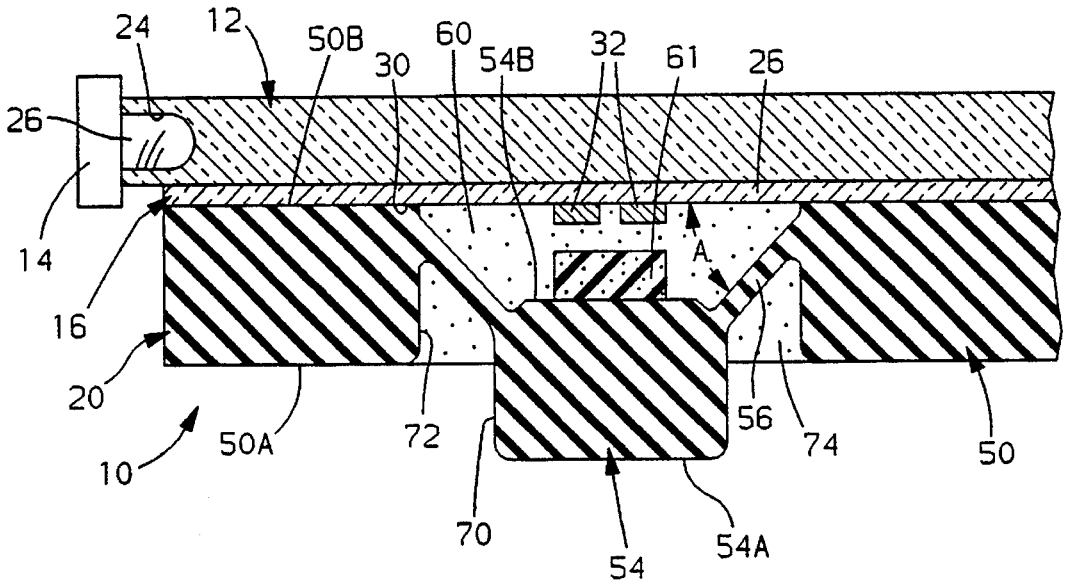
FIG. 2 is an enlarged, fragmentary cross-sectional view of an assembled elastomeric keyboard switch assembly as shown in FIG. 1 and taken approximately along lines 2—2 of FIG. 1 when the switch assembly is assembled.

The keypad 20 also includes a plurality of opaque key caps 54–59 integrally connected with the base 50. The key caps 54–59, except for their overall shape, are of an identical construction and hence only the key cap 54 will be described in detail, and corresponding parts of the key caps 55–59 will be given the same reference numerals. The key cap 54 is integrally connected with the base 50 by an annular web 62 surrounding the key cap 54. The key cap 54 is of the same approximate thickness as the base 50 so that no light can be transmitted through the key cap 54 from the light pipe 12. The key cap 54 has an upper surface 54A which is substantially planar and located outwardly from or above the exterior side 50A of the base 50. The key cap 54 has a planar bottom surface 54B to which a suitable electrically conductive pellet 61 is secured. The bottom surface 54B is disposed above and spaced from the plane of the upper surface of the printed circuit means 16. The top and bottom surfaces 54A and 54B, respectively, lie in planes which are parallel to the plane of the upper surface 50A of the base 50 of the key pad 20. The pellet 61 bridges a pair of the spaced contact ends 32 of one of the printed circuits 28. The bottom surface 54B of key cap 54, the annular web 62 and the base 50 at its bottom side 50B define a trapezoidally shaped recess 60. The web 62 is integrally connected with the base 50 adjacent its bottom side 50B and are integrally connected with the key cap 54 adjacent its bottom side or bottom 54B. The web 62 is thin and of a uniform thickness. As shown in FIG. 2, the web 62 lies in a plane which forms an acute included angle A with the printed circuit means 16. The web 62 is translucent in that it is thin enough to allow light to pass therethrough from the light pipe 12.

The key cap 54 has a peripheral side 70 which is spaced inwardly from side 72 of the base 50 to define an annular well or recess 74 in the base 50. The annular recess or well 74 is defined by the sides 70, 72 of the key cap 54 and the base 50, respectively, and the annular web 62. The sides 70 of the key cap 54 extends perpendicular to the plane of the printed circuit means 16 or light pipe 12 and the side 72 in the base 50 also extends perpendicular to the plane of the printed circuit means 16 or the light pipe 12. The perpendicular side 72 of the base 50 serves to direct light being transmitted from the light pipe 12 via the transparent printed circuit means 16 and the web 62 upwardly to create a halo lighting effect surrounding the key cap 54.

The annular web 62 serves as a spring means for biasing the key cap 54 toward a normal position, as shown in FIG. 2, in which the pellet 61 carried thereby is disposed above the contact ends 32 of a printed circuit line 28. The web 62 can be deflected by depression of the key cap 54 to move the pellet 61 into engagement with the contact ends 32 of a printed circuit 28 to complete an electric circuit to energize or de-energize an electrical device. Upon release of the key cap 54, the web 62 will return the key cap 54 to its normal position. The annular web 56 also serves to transmit light therethrough and with the side wall 72 of the keypad 20 serving to direct the light through the web 62 to create a highly visible halo lighting effect around the key cap 54.

The keypad 20 and its key caps 54–59 can be designed to control the energization and deenergization of any variety or suitable electrical devices (not shown). The key cap 54 could, for example, be used to control the on/off of a blower motor, as indicated by depressing the key cap at its upper (+) or lower (–) end. The key caps 55 could be used to control other speeds of the blower motor. The key cap 56 could be used to control the on/off of a defroster. The key caps 57 could be used to control the on/off of an electrically operated rear window defogger. The key caps 58, 58A could be used to control the energization of drivers and passenger side rear view mirrors, respectively. The key cap 59 could be used to control the up, down, left and right adjustments to the driver and passenger side view mirrors, depending upon which key cap 58 or 58A had been depressed.

Another advantage of the present invention is that the keypad 20 can be molded from a suitable elastomeric material having virtually any color except extreme dark colors, such as black. The light transmitted from the light pipe 12 through the transparent printed circuit means 16 and through the webs 56 will have the same color as the keypad itself so that the halo light will be a complementary color by taking on the coloration of the keypad 20.

From the foregoing, it should be readily apparent that a very simple, inexpensive illuminated keypad switch assembly has been provided. All three items, namely, the light pipe 12, the printed circuit means 12 and the keypad 20 can be made relatively thin. When the three parts are secured together, a thin switch package is provided which can be readily attached to an interior of an automotive vehicle, such as a dashboard, door trim panel, etc.

Figure 3:
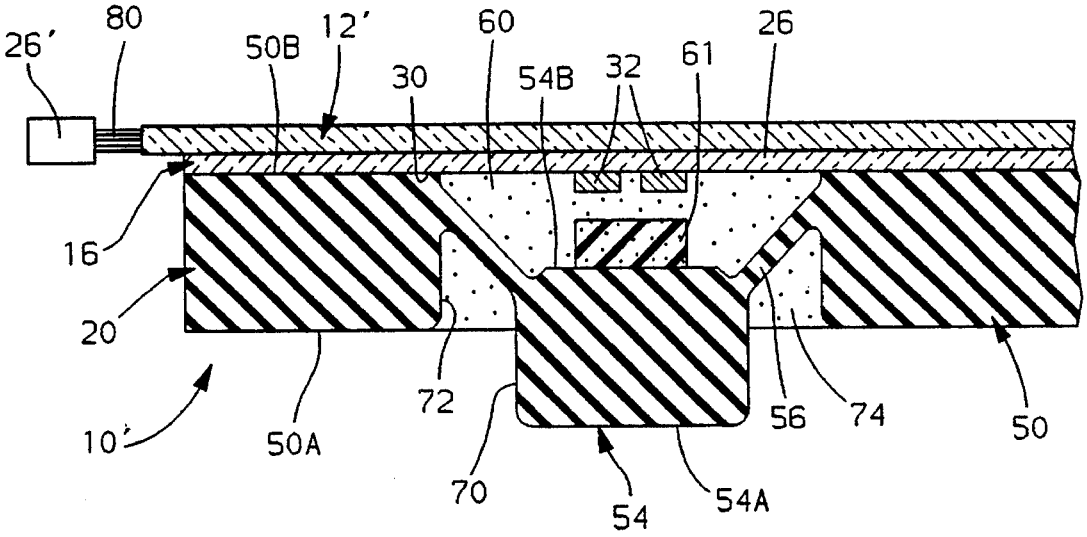
FIG. 3 is a fragmentary, cross-sectional view like that shown in FIG. 2 but showing a different optical conductor.

FIG. 3 shows a switch assembly 10' which is identical to the switch assembly 10 shown in FIGS. 1 and 2 except that a thinner light pipe 12' is employed to make the switch package even thinner. In this embodiment, the light pipe 12' is connected to a suitable optical light source 26' via fiber optic connectors 80. In all other respects, the switch assembly 10' is identical to the previously described switch assembly 10 and the same reference numerals have been given to the corresponding parts.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An illuminated elastomeric keypad switch assembly comprising an optical conductor which is adapted to be connected with a light source, a printed circuit means secured at a lower surface thereof to said optical conductor and which is adapted to be electrically connected to various electrical devices to be energized and de-energized, said printed circuit means having a transparent base and a plurality of printed circuit traces on said base which terminate in contact ends closely adjacent each other, a one piece keypad made from an elastomeric material and overlying an upper surface of said printed circuit means, said keypad having a base of a thickness such that light from the optical conductor does not pass therethrough, a plurality of opaque key caps each having a bottom surface carrying an electrically conductive pellet and located above a pair of said contact ends, and thin annular translucent webs integral with said base of said key pad and integral with said key caps for connecting said key caps to said base of said key pad, said thin annular webs biasing said key caps toward a normal position in which said pellets carried by said key caps are spaced from the contact ends of said printed circuit traces, said key caps being depressible to deflect said annular webs to move the pellets carried thereby to engage said contact ends of said printed circuit traces to complete a circuit, said annular webs functioning as both a spring to bias the key caps toward their normal position and to transmit light from said optical conductor therethrough to create a halo lighting effect around said key caps.

2. An illuminated elastomeric keypad switch assembly comprising an optical conductor which is adapted to be connected with a light source, a printed circuit means secured at a lower surface thereof to said optical conductor and which is adapted to be electrically connected to various electrical devices to be energized and de-energized, said printed circuit means having a transparent base and a plurality of printed circuit lines on said base and with selective ones thereof terminating in contact ends closely adjacent each other, a one piece keypad made from an elastomeric material and overlying an upper surface of said printed circuit means, said keypad having a base of a thickness such that light from the optical conductor does not pass therethrough, a plurality of opaque key caps each having a bottom surface carrying an electrically conductive pellet and located above a pair of said contact ends and thin annular translucent webs for integrally connecting said key caps to said keypad said key caps each having an outer peripheral side wall which is spaced inwardly from a side wall of said keypad surrounding said key caps, said side wall of said keypad extending substantially perpendicular to said printed circuit base, said thin annular translucent webs being integral with said side wall of said key pad adjacent its underside and integral with said key cap adjacent its bottom side, said annular side walls of said keypad, side walls of said key caps and thin annular webs defining annular recesses in said key pad surrounding said key caps, said thin annular webs biasing said key caps toward a normal position in which said pellets carried by said key caps are spaced from said contact ends of said printed circuit lines, said key caps being depressible to deflect said annular webs to move the pellets carried thereby to engage said contact ends of said printed circuit lines to complete a circuit, said annular webs functioning as both a spring to bias the key caps toward their normal position and to transmit light from said optical conductor therethrough and with the side walls of the key pad serving to direct light through the webs to create a visible halo lighting effect around said key caps.

3. An illuminated elastomeric keypad switch assembly, as defined in claim 2, and wherein said outer peripheral side walls of said key caps extend substantially perpendicular to said printed circuit base.

4. An illuminated elastomeric keypad switch assembly, as defined in claim 2, and wherein said optical conductor comprises a substantially rigid, thin, planar light conducting member.

5. An illuminated elastomeric switch assembly, as defined in claim 4, and wherein said printed circuit base is a flexible membrane.

6. An illuminated elastomeric keypad switch assembly, as defined in claim 5, and wherein said optical conductor, printed circuit means and keypad are of the same shape and comprise a thin package when assembled together.

7. An illuminated elastomeric keypad switch assembly comprising a substantially rigid optical conductor which is adapted to connect with a light source, a printed circuit means secured at lower surface thereof to said optical conductor, and which is adapted to be electrically connected to various electrical devices to be energized and de-energized, said printed circuit means having a transparent base and a plurality of printed circuit lines on said base which terminate in contact ends closely adjacent each other, a one piece keypad made from an elastomeric material and overlying an upper surface of said printed circuit means, said keypad having a base of a thickness such that light from the optical conductor does not pass therethrough, said keypad having a plurality of first recesses on its underside and with each of the first recesses overlying at least one pair of adjacent contact ends of the printed circuit lines, said keypad also having a second plurality of recesses on its exterior side each defined in part by an annular side on said keypad which is substantially perpendicular to said keypad, a plurality of opaque key caps each having a bottom surface carrying an electrically conductive pellet, a top exterior surface disposed above the exterior side of said base of said keypad and an annular peripheral side wall extending substantially perpendicular to said keypad base and spaced inwardly from said annular side wall on the exterior side of said keypad, and a thin annular translucent web integral with said annular side wall of said key pad adjacent its underside and integral with said peripheral side wall of the key cap adjacent its bottom side, said annular side walls of said keypad, side walls of said key caps and said thin webs defining annular recesses in said key pad surrounding said key caps, said thin annular webs biasing said key caps toward a normal position in which said pellets carried by said key caps are spaced from the contact ends of said printed circuit lines, said key caps being depressible to deflect said annular webs to move the pellets carried thereby to engage said contact ends of said printed circuit lines to complete a circuit, said annular webs functioning as both a spring to base the key caps toward their normal position and to transmit light from said optical conductor therethrough and with the side walls of the keypad serving to direct light through the webs to create a halo lighting effect surrounding said key caps.

8. An illuminated elastomeric keypad switch assembly, as defined in claim 7, and wherein said optical conductor, printed circuit means and said keypad are complementary shaped.

9. An illuminated elastomeric keypad switch assembly, as defined in claim 8, and wherein said optical conductor is a thin planar member, said printed circuit means is thin and planar in shape and said keypad is thin and generally planar whereby said switch assembly when assembled together comprises a thin package.

* * * * *